United States Patent [19]

Morrison et al.

[11] 4,211,030

[45] Jul. 8, 1980

[54] SPACE TOY

[75] Inventors: Howard J. Morrison, Deerfield; Denise Gardner, Downers Grove; Palmer J. Schoenfield, Evanston, all of Ill.

[73] Assignee: Marvin Glass & Associates, Chicago, Ill.

[21] Appl. No.: 10,830

[22] Filed: Feb. 9, 1979

[51] Int. Cl.[2] ..... A63H 1/06

[52] U.S. Cl. ..... 46/67; 46/32; 46/66; 272/31 R

[58] Field of Search ..... 46/65, 66, 67, 68; 272/31 R

[56] References Cited

U.S. PATENT DOCUMENTS

| | | | |
|---|---|---|---|
| 256,192 | 4/1882 | Barnes | 272/31 R |
| 1,285,595 | 11/1918 | Beach | 46/66 |
| 2,950,641 | 8/1960 | Bruetting | 46/66 X |
| 3,583,092 | 6/1971 | Schoenfield | 46/66 |

FOREIGN PATENT DOCUMENTS

| | | | |
|---|---|---|---|
| 25288 | 12/1883 | Fed. Rep. of Germany | 46/67 |

*Primary Examiner*—F. Barry Shay

*Attorney, Agent, or Firm*—Mason, Kolehmainen, Rathburn & Wyss

[57] ABSTRACT

A space toy in the form of a vehicle includes a base and rotatably mounted vehicle body. The body of the vehicle rotatably mounts a plurality of exterior pods and includes removable, shuttle craft portions. A manually operable rack mechanism is operative to rotate the vehicle body in one direction while rotating the pods in an opposite direction. A plurality of toy figures are provided and cooperatively engage portions of the vehicle body, pods and shuttle craft to provide a realistic and operative space vehicle. Shock absorbing cushions on the base portion are provided with sounding mechanisms which are actuated upon manual operation of the body rotating rack mechanism.

14 Claims, 6 Drawing Figures

Fig 1
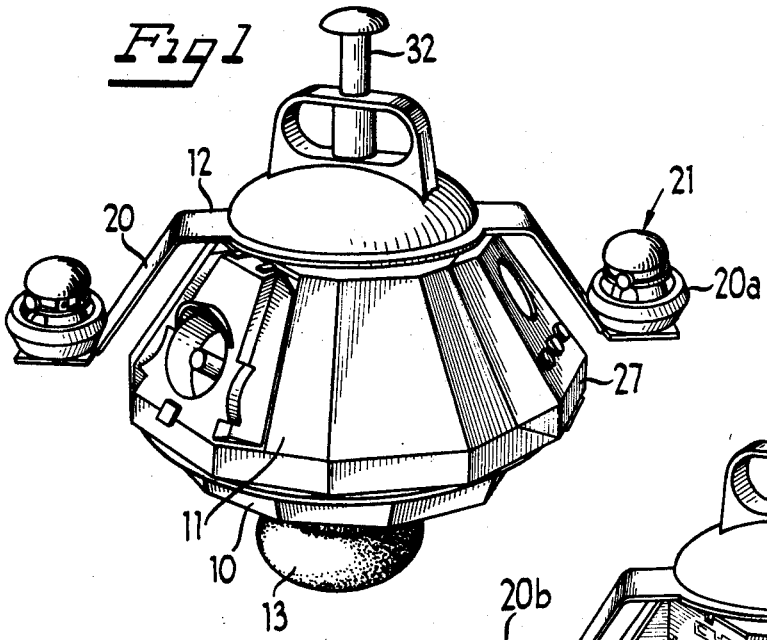
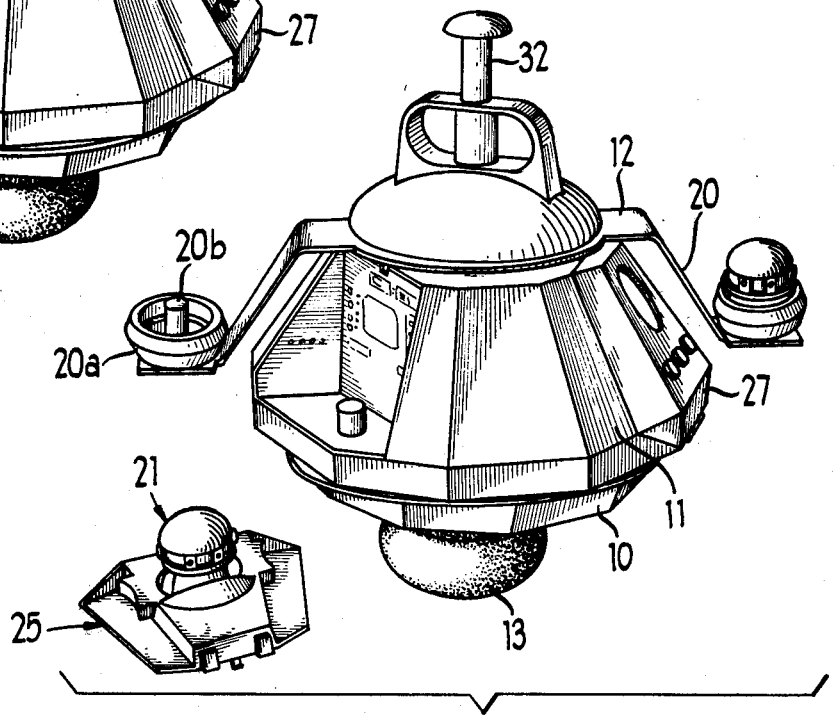
Fig 2
Fig 3
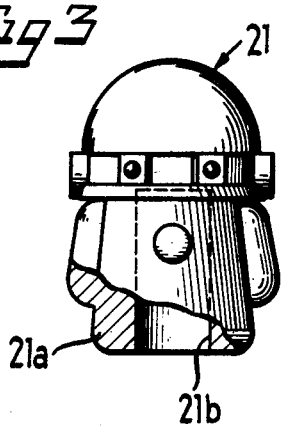
Fig 4
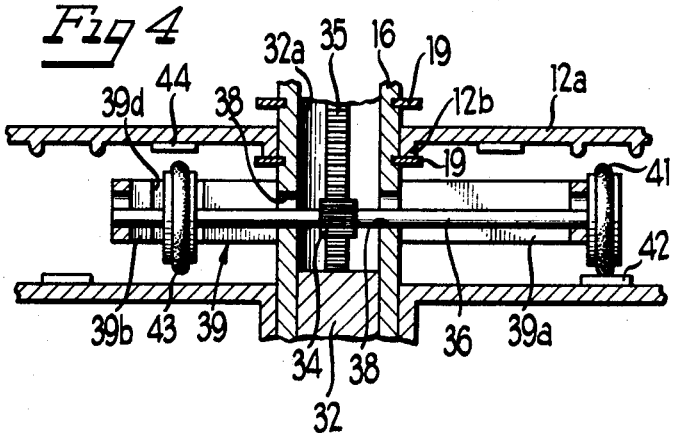

SPACE TOY

SUMMARY OF THE INVENTION

The present invention relates to toys and more particularly to an improved toy space vehicle which is easily operable to simulate the behavior of reported unidentified flying objects.

It is an object of the present invention to provide an improved toy space vehicle of the character indicated which is easy and safe to operate and is of rugged low cost construction.

It is a further object of the invention to provide a toy space vehicle of the character described which features the inclusion of manually operable moving parts which in movement emulate the reported movement behavior of unidentified flying objects.

Still another object of the invention is to provide a toy space vehicle of the character indicated which embodies noise making facilities for simulating the reported sounds emitted by reported unidentified flying objects.

The invention, both as to its organization and method of operation, together with further objects and advantages thereof, will best be understood by reference to the following specification, taken in connection with the accompanying drawings, in which:

BRIEF DESCRIPTION OF THE DRAWINGS

FIG. 1 is an elevational perspective view illustrating one embodiment of the present improved toy space vehicle;

FIG. 2 is a view similar to FIG. 1, but showing the space shuttle craft forming a part of the space vehicle structure detached from the main body of the structure;

FIG. 3 is a view, partially in section, illustrating the details of one of the detachable toy space men normally forming a part of the toy space vehicle structure;

FIG. 4 is a fragmentary sectional view illustrating certain details of a portion of the drive mechanism of the vehicle;

DESCRIPTION OF THE PREFERRED EMBODIMENT

Figure 5:
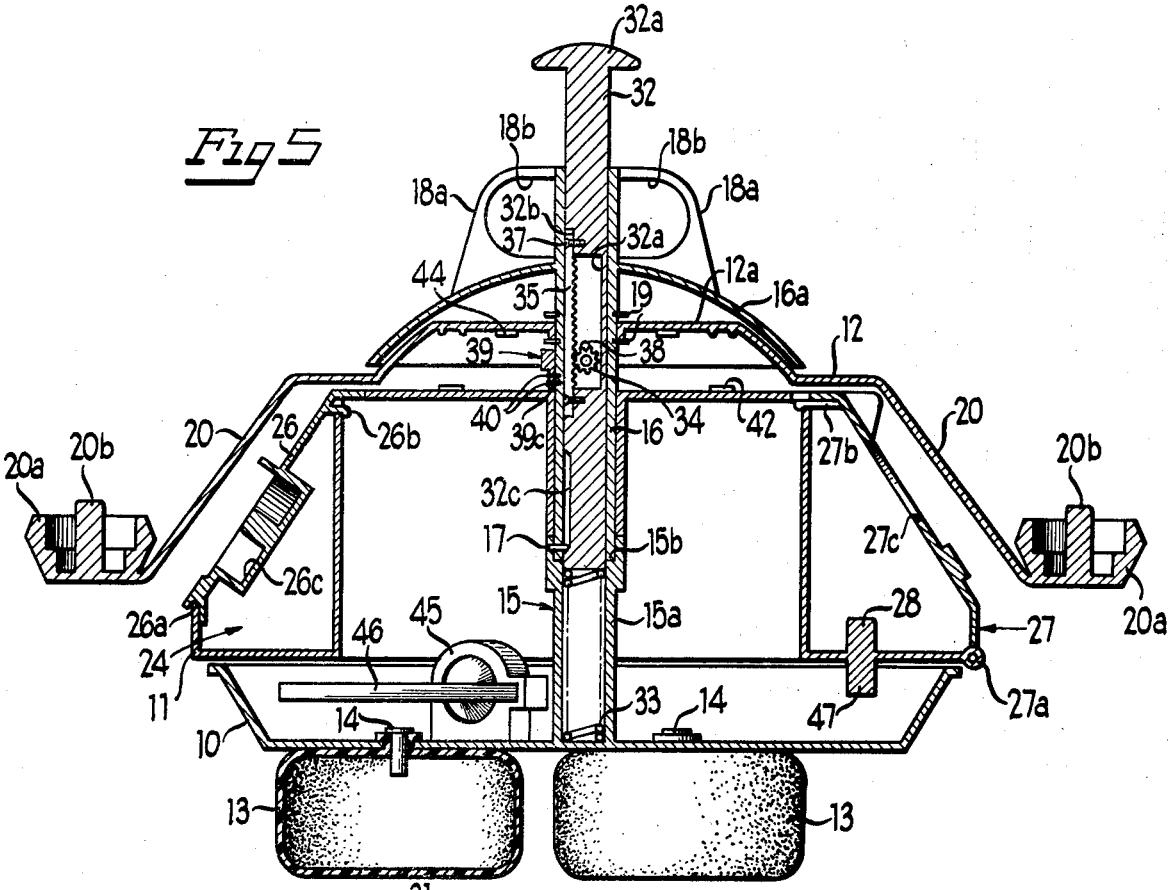
FIG. 5 is a sectional view taken along the lines 5—5 in FIG. 6.

Referring now to the drawings, the present improved toy space vehicle is illustrated as comprising a base 10 upon which is rotatably mounted a vehicle body 11 and a toy space man carrier 12. These components are mounted one above the other in the order named. As best shown in FIG. 5 of the drawings, the base 10 has affixed to the bottom wall 10*a* thereof in spaced apart relationship three hollow rubber air filled pads 13 which serve to support the base 10 on a supporting surface, such as a tabletop, or the like. The interior of each of the pads 13 is connected to the atmosphere by means of a small air whistle 14 which functions to emit noise when the associated pad is depressed or collapsed in the manner more fully explained below.

More in detail and again as best shown in FIG. 5 of the drawings, a two-part hollow upstanding pivot post 15 is provided which is centrally located on the base 10 and serves to support the vehicle body 11 and the carrier 12 for rotation about a common axis, i.e., the longitudinal center of the post 15. The lower portion 15*a* of the post 15 is preferably formed integrally with the bottom wall 10*a* of the base 10 and is provided with a recessed seat 15*b* for receiving the lower end of the upper part 16 of the post 15. A pin 17 is employed to hold the two post parts 15*a* and 16 in assembled relationship. Adjacent its upper end, the post part 16 is provided with an inverted dish-shaped cover 16*a* which overlies the rotatable carrier 12. Integrally formed with the post part 16 and the cover 16*a* are a pair of upstanding ribs 18*a* which have finger receiving openings 18*b* formed therethrough to serve the purpose described below.

At its center, the carrier 12 comprises an inverted dish-shaped portion 12*a* which underlies the cover 16*a* and terminates inwardly in a downwardly extending bearing flange 12*b* journalled for rotation about the upper post part 16. The vertical position of the carrier 12 along the post 16 is maintained by means of vertically spaced spring rings 19 which are received within circular recesses formed around the upper post part 16 and the lower one of which acts as a friction bearing against which the lower edge of the bearing flange 12*b* bears. The carrier 12 also includes two diametrically opposed radially extending arms 20 which extend outwardly and downwardly along the slanted walls of the vehicle body 11 and terminate in space man supporting platforms or pods 20*a* having the function of detachably supporting spacemen of the form illustrated in FIG. 3 of the drawings. More particularly, each spaceman, generally indicated at 21, is of the usual shape created by human fantasy and is provided with a skirted lower end 21*a* which is adapted to seat in one of the recessed pods 20*a*. Each pod 20*a* is provided with an upwardly extending stud 20*b* which is adapted to be received within an opening 21*b* formed in each spaceman 21 from the base up, thereby securely to anchor each spaceman in the pod in which it is mounted.

Figure 6:
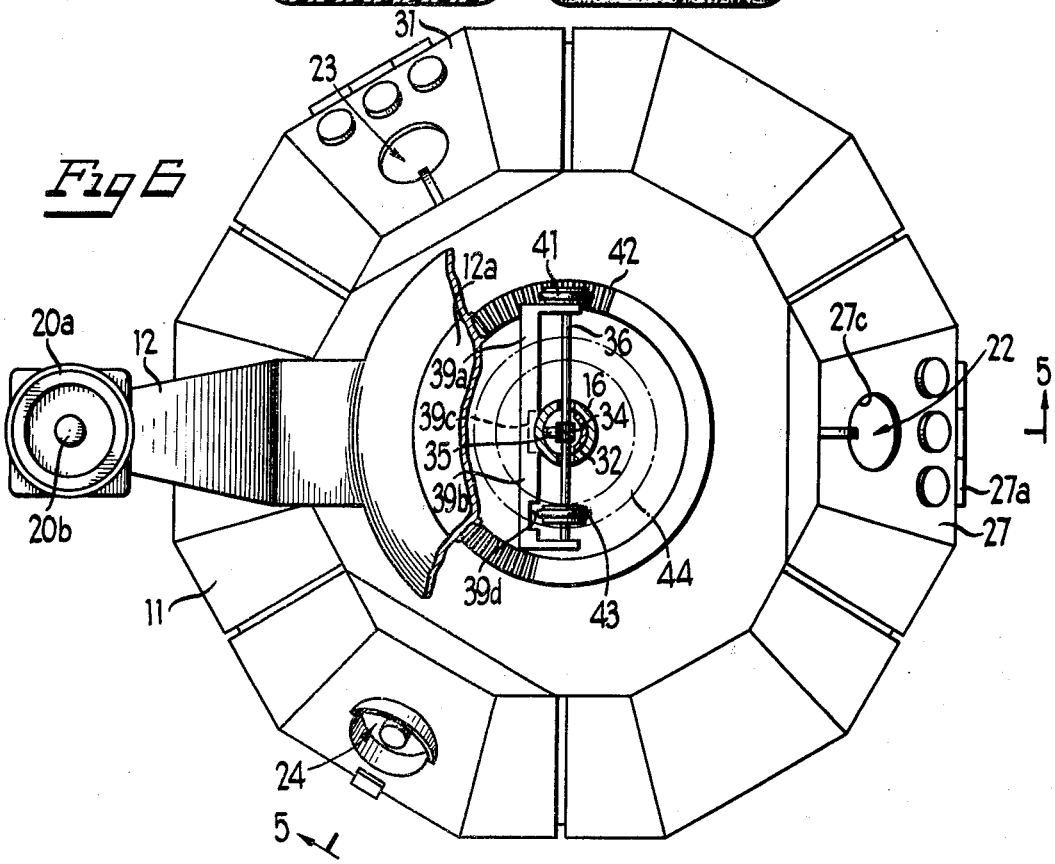
FIG. 6 is a top elevational view of the vehicle partially broken away to illustrate further details of the drive mechanism embodiment in the vehicle.

As best shown in FIG. 6 of the drawings, the vehicle body 11 is of flat panelized construction and is provided with three internally formed compartments 22, 23 and 24 for receiving a shuttle space craft 25 of the form illustrated in FIG. 2 and two spacemem 21. A cover plate 26 detachably mounted on the main frame of the vehicle body 11 in any suitable manner, as, for example, by the lower groove edge 26*a* and the upper lipped projection 26*b*, normally closes the compartment 24. The cover plate is provided with a depressed platform or pod 26*c* which faces outwardly to support one of the spacemen 21. The compartment 22 is normally closed by an apertured cover plate 27 which is hinge mounted on the main frame of the vehicle body along its lower edge by means of a hinge 27*a*. This cover plate is normally held closed by a spring latch 27*b* located at the top edge of the cover plate and engageable with the edge of an aperture formed in the back wall of the compartment 22. A stud 28 is provided to project upwardly from the bottom wall of the compartment 22 and support one of the spacemen in the compartment in such a position that the head of the spaceman may be viewed through the aperture 27*c* in the cover plate 27.

The compartment 23 is adapted to receive and hold a shuttle craft 25 of the form illustrated in FIG. 2 of the drawings. This craft is of a futuristic design and is apertured at its center to receive a spaceman 21, the opening 21*b* of which is adapted to receive a stud 30 projecting upwardly from the floor of the compartment. If desired, the side walls of the compartment 23 may be figured as shown to simulate the appearance of the instrument panel of an aircraft. A centrally apertured cover plate 31 is provided for normally closing the compartment 23. This cover plate is hinge mounted along its lower edge on the mating edge of a part of the main frame of the vehicle body 11 and is normally held in its closed position by a spring clip retaining element.

In order to impart rotary movement to the vehicle body 11 and the carrier 12 with respect to the base 10, a reciprocator in the form of a manually operable plunger 32 is provided. This plunger, which is movable down and up between retracted and depressed vertical positions, cooperates with the drive means or a drive mechanism described below to rotate the vehicle body 11 in one direction and the carrier 12 in the opposite direction. More specifically and as best shown in FIG. 5 of the drawings, the plunger 32 is telescoped within the upstanding post 16 for vertical sliding movement within the post. Adjacent its lower end, the plunger 32 is provided with an elongated keyway recess **32*c* which cooperates with the inner end of the assembly pin 17 to restrain the plunger against rotation relative to the post 15 and to limit vertical movement of the plunger. For the purpose of moving the plunger 32 from its depressed position to its retracted position when manual pressure exerted upon the knob 32*a* of the plunger is released, a strong compression spring 33 is positioned in the lower hollow end of the post part 15*a* to react between the bottom wall of the vehicle body 10 and the lower end of the plunger. Approximately midway along its length, the plunger 32 is provided with a deep ratchet pinion receiving recess 32*a* for accommodating a ratchet pinion gear 34** forming a part of the drive mechanism.

The pinion gear cooperates with the internally facing teeth of a rack 35 to impart rotary movement to a drive shaft 36 in response to down and up movement of the plunger 32 within the post 15. The transversely curved rack 35 is mounted within an enlarged shallow recess formed in the side of the plunger at the ends of the deeper recess **32*b* by means of assembly screws 37. The recess 32*a* extends transversely all the way through the plunger 32 to permit limited down and up movement of the pinion gear 34 and the drive shaft 36 upon which this gear is mounted. Such down and up movement of the two last-named parts is limited by journalling the shaft 36 in vertically extending bearing slots 38 formed in the opposed wall parts of the upper post part 16. Adjacent its outer ends, the drive shaft 36 is supported by bearing slotted legs extending downwardly from a shaft carrier 39, the supporting arms 39*a* and 39*b* of which radiate outwardly from the center post 16 in the manner best shown in FIGS. 4 and 6 of the drawings. In order to support the shaft carrier 39 and to restrain the same against rotation, this component is provided with a curved downwardly extending flange 39*c* which is fixedly connected to the post part 16 by means of machine screws 40**.

At its upper end as viewed in FIG. 6 of the drawings, the drive shaft 36 has fixedly mounted thereon for rotation therewith a rubber tired drive wheel 41 which is adapted to engage a serrated circular track 42 formed on or fixedly attached to the outer side of the top wall of the vehicle body 11 thereby to rotate the vehicle body 11 in response to downward movement of the plunger 32 from its retracted position to its depressed position. Adjacent the opposite lower end of the drive shaft 36, a second rubber tired drive wheel 43 is provided which is adapted to cooperate with a second circular serrated track 44 formed on or fixedly attached to the under surface of the carrier part **12*a* to rotate the carrier 12 in response to upward movement of the plunger 32 from its depressed position to its retracted position. As best shown in FIGS. 5 and 6 of the drawings, the circular tracks 42 and 44 are of different diameters although they have a common center which is coincident with the common axis of rotation of the vehicle body 11 and the carrier 12. As shown in FIG. 6, the shaft carrier arm 39*b* is provided with a recess 39*d* along the length thereof opposite the drive wheel 43 to unrestricted rotation of this wheel relative to the shaft carrier 39**.

For the purpose of producing child pleasing noise in response to rotation of the vehicle body 11 relative to the base 10, a small diaphragm equipped speaker 45 is provided which is mounted upon and extends upwardly from the top wall of the base 10. This speaker includes a vibratory drive spring 46 which serves to vibrate the speaker diaphragm and thus produce sound when the spring is energized into vibratory motion. Activation of the speaker 45 is effected by providing a striker element 47 which is mounted upon and projects downwardly from the bottom wall of one of the compartments 22 or 23. This striker element briefly engages the free end of the vibratory spring 46 to induce sound producing vibration of the speaker diaphragm during each revolution of the vehicle body 11 relative to the base 10.

OPERATION

It is believed that the operation of the present improved toy space vehicle will be readily understood from the foregoing explanation. Briefly summarized, however, it will be understood that when the device is not in use the moving parts thereof occupy the positions illustrated in FIG. 5 of the drawings. To prepare the device for operation, the compartments 22, 23 and 24 are preferably closed and the carrier pods **20*b* are loaded with spacemen 21. These space men are preferably formed of a dense heavy material in order to enhance the centrifugal force effect exerted on the carrier 12** to sustain rotation of this carrier once it is set into rotation.

Rotation of the vehicle body 11 relative to the base 10 may be initiated in either of two ways. If sound is desired, the operator simply pushes down on the plunger knob **32*a* to move the plunger 32 from its retracted position to its depressed position. As such movement occurs, the rack and pinion connection between the plunger 32 and the shaft 36 serves to rotate the shaft in a counterclockwise direction as viewed in FIG. 4 of the drawings. During the initial portion of such movement, the shaft 36 and the drive wheels 41 and 43 carried thereby are moved virtually downward to disengage the drive wheel 43 from the circular track 44 and to bring the wheel 41 into drive engagement with the circular track 42. It will be understood that the slotted bearing openings 38 in the upper post part 16 and the corresponding slotted openings in the bearing legs of the shaft carrier 39 permit such limited vertical movement of the shaft 36 and the wheels 41 and 43 carried thereby. Continued movement of the plunger 32 toward its depressed position results in clockwise rotation of the body 11 relative to the base 10 as viewed in FIG. 6 of the drawings, due to the driving force exerted thereon through the driving connection which compresses the rack 35, the pinion 34, the shaft 36, the drive wheel 41 and the circular track 42. Also during such continued movement of the plunger 32 toward its fully depressed position, the coil spring 33 is compressed and energy charged until it reaches its fully depressed position in the post part 15***a*. Continuing downward pressure exerted on the plunger knob 32*a* results in flattening compression of the hollow flexible rubber pads 13. As this occurs, air expelled from the pads through their respective associated whistles 14 serves to activate these whistles and produce sounds in the form of musical notes. If desired, the whistles may be designed to emit different notes so that a pleasing composite sound or musical chord is produced.

Additional sound is produced through activation of the speaker 45 as rotation of the vehicle body 11 is initiated. Thus during each revolution of the vehicle body 11 relative to the base 10, the striker 47 contacts and passes over the end of the vibratory spring 46. The resulting vibratory movement of the spring 46 drives the diaphragm of the speaker 45 causing the speaker to emit sound having a frequency related to the natural resonant frequency related to the natural resonant frequency of the spring.

If it is desired to initiate rotation of the vehicle body 11 and to activate the speaker 45 without activating the whistles 14, the operator simply grasps the upstanding ribs 18*a* through the finger receiving openings 18*b* and squeezes the plunger knob 32*a* to produce downward movement of the plunger 32 from its retracted position to its fully depressed position without producing flattening compression of the pads 13. The resulting rotation of the vehicle body 11 and activation of the speaker 45 are effected in the exact manner explained above.

In the above described operational mode, the pads 13 are depressed to activate the whistles 14 after the spring 33 is fully depressed within the bore of the post part 15*a*. It will be understood, however, that if the compressibility of the spring 33 is properly proportional relative to the compressibility of the pads 13, the pads may be depressed or flattened as the spring 33 is compressed. As a result, the whistles 14 are activated during downward movement of the plunger 32 from its retracted position to its fully depressed position. As a further alternative, the compressibility of the spring 33 may be made much greater than the compressibility of the pads 13, in which case the pads are depressed to activate the whistles 14 before any substantial downward movement of the plunger 32 relative to the base 10 can occur.

Once the plunger 32 has been moved to its fully depressed position, or to a partially depressed position for that matter, manually exerted pressure on the plunger knob should be quickly and totally released. In response to the release of pressure on the knob 32*a*, the energy charged spring 33 immediately starts moving the plunger 32 from its depressed position toward its fully retracted position. If depressed or flattened, the resilient pads 13 are also relieved from downward pressure and gradually self-restore to their normal contours illustrated in FIG. 5 of the drawings. During this pad self-restoring operation, air is sucked into the hollow pads 13 through the whistles 14 and the entire structure of the toy space vehicle is elevated to simulate a vehicle take-off operation.

During the initial upward movement of the plunger 32 toward its retracted position, the drive shaft 36 is engaged by the lower surfaces of the slotted bearings 38 to move the shaft 36 and the drive wheels 41 and 43 upward thus disengaging the drive wheel 41 from the track 42 and breaking the driving connection between the reciprocating plunger 32 and the vehicle body 11. As a consequence, the vehicle body 11 is freed from restraint and continues its free clockwise rotation about the post 15. As will be understood, interrupted activation of the speaker 45 continues so long as inertia effects continue to maintain rotation of the vehicle body 11.

As the drive shaft 36 and the wheels 41 and 43 are moved upward with the plunger 32, the drive wheel 43 is brought into driving engagement with the track 44 to establish a driving connection between the upwardly moving plunger 32 and the carrier 12. This connection includes the rack 35, the pinion 34, the shaft 36, the drive wheel 43 and the track 44. This connection serves to rotate the carrier 12 in a counterclockwise direction as viewed in FIG. 6 of the drawings. Obviously, the drive wheel 41 rotates freely during this carrier driving operation. Upward movement of the plunger 32 to drive the carrier 12 continues until the bottom end of the keyway 32*c* engages the inner end of the pin 17 and arrests such plunger movement.

When upward movement of the plunger 32 stops, the plunger may be immediately depressed again, thereby to move the shaft 36 and wheels 41 and 43 downward to reestablish the above described driving connection between the plunger 32 and the vehicle body 11. During the initial movement of the shaft 36 within the slotted bearings 38, the drive wheel 43 is disengaged from the track 44 thus freeing the carrier 12 for continued centrifugally inspired rotation about the post part 16. This rotation is continued and prolonged if the carrier pods 20*a* are loaded with the relatively heavy spacemen 21.

From the foregoing explanation it will be understood that by repeatedly depressing the plunger 32, the child operator of the present improved toy space vehicle may maintain rotation of the vehicle body 11 and the carrier 12, as well as activation of the speaker 45, substantially continuously. Moreover, provision of the compartments 22, 23 and 24 in the vehicle body affords storage space for the spacemen 21 and other toy space gear and thus enhances the game-making possibilities of the toy.

While there has been described what is at present considered to be the preferred embodiment of the invention, it will be understood that various modifications may be made therein without departing from the spirit of the invention as defined in the appended claims.

We claim:

1. A toy space vehicle comprising a base, a vehicle body rotatably supported on said base, a carrier rotatably supported on said base, said body and said carrier being independently rotatable about a common axis, a manually operable reciprocator movable in two directions, and drive means responsive to movement of said reciprocator in one direction for rotating said body relatively to said base and responsive to movement of said reciprocator in the other direction for rotating said carrier relatively to said base and independently of said body.

2. A toy space vehicle as claimed in claim 1 wherein spring means are provided for moving said reciprocator in one of said two directions and said reciprocator is manually movable against the action of said spring means in the other of said two directions.

3. A toy space vehicle as claimed in claim 1 wherein said drive means is operable to rotate said body and said carrier in opposite rotational directions in response to movement of said reciprocator in different ones of said two directions.

4. A toy space vehicle as claimed in claim 2 wherein said drive means is operable to rotate said carrier in one rotational direction in response to movement of said reciprocator in one of said two directions under the influence of said spring means and is operable to rotate said body in the opposite rotational direction when said reciprocator is manually moved in the other of said two directions.

5. A toy space vehicle as claimed in claim 1 wherein said reciprocator comprises a manually depressable plunger located at and defining the common rotational axis of said body and said carrier.

6. A toy space vehicle as claimed in claim 2 wherein said reciprocator comprises a manually depressable plunger located at and defining the common rotational axis of said body and said carrier, and said spring means comprises a depressable coil spring disposed in axial alignment with said plunger and supported by said base.

7. A toy space vehicle as claimed in claim 1 wherein said drive means comprises at least one drive wheel radially displaced from said common axis and a drive shaft for imparting rotation to said drive wheel in response to movement of said reciprocator in either of said two directions.

8. A toy space vehicle as claimed in claim 7 wherein said drive shaft is rotated in opposite rotational directions in response to movement of said reciprocator in different ones of said two directions.

9. A toy space vehicle as claimed in claim 7 wherein said body is provided with a circular track surface having said common axis as its center which is engageable by said drive wheel to establish a driving connection between said reciprocator and said body.

10. A toy space vehicle as claimed in claim 7 wherein said body and said carrier are provided with facing circular track surfaces having said common axis as their common center, and wherein one of said track surfaces is engaged by said drive wheel to rotate said body in one rotational direction in response to movement of said reciprocator in one of said two directions and the other of said track surfaces is engaged by said drive wheel to rotate said carrier in the opposite rotational direction in response to movement of said reciprocator in the other of said two directions.

11. A toy space vehicle comprising a base, a vehicle body rotatably supported on said base, a carrier rotatably supported on said base above said body, said body and said carrier being independently rotatable about a common axis, a hollow post extending upwardly from said base rotatably to support said body and said carrier and to define said common rotational axis, a partially hollow plunger slidably disposed in said hollow post and adapted to be manually depressed from a retracted position to a depressed position, depressible spring means disposed in said hollow post for moving said plunger from its depressed position to its retracted position when manual pressure on said plunger is released, and drive means at least partially disposed in said partially hollow plunger for rotating said body and said carrier relative to said base in response to movement of said plunger between said positions.

12. A toy space vehicle as claimed in claim 11 wherein said drive means comprises a drive shaft extending through said hollow post, drive wheels mounted upon said shaft and engageable with said body and said carrier to effect rotation of said body and carrier relative to said base, and a rack and pinion connection between said plunger and said shaft to effect rotation of said shaft in response to movement of said plunger between its retracted and depressed positions.

13. A toy space vehicle as claimed in claim 12 wherein said drive shaft extends through the hollow portion of said plunger and said plunger is provided with a rack portion having internally facing rack teeth, and wherein said rack and pinion connection includes a pinion gear mounted for rotation with said shaft and engageable with said rack teeth to effect rotation of said shaft in response to movement of said plunger between its retracted and depressed positions.

14. A toy space vehicle as claimed in claim 12 wherein said plunger and said spring means are alternately operable to move said shaft down and up longitudinally of said post, thereby to effect engagement and disengagement of said drive wheels with said carrier and said body.

* * * * *